US005794549A

United States Patent [19]

Carter

[11] Patent Number: 5,794,549

[45] Date of Patent: Aug. 18, 1998

[54] COMBUSTION OPTIMIZATION SYSTEM

[75] Inventor: Hudson R. Carter, Forest, Va.

[73] Assignee: Applied Synergistics, Inc., Lynchburg, Va.

[21] Appl. No.: 591,012

[22] Filed: Jan. 25, 1996

[51] Int. Cl.[6] ..... F23N 5/00; F23N 5/24; F23M 11/04

[52] U.S. Cl. ..... 110/347; 110/185; 110/186; 110/188; 110/190; 110/263; 110/341; 110/348; 431/12; 431/13; 431/14; 431/75; 236/15 BA; 236/15 BB; 236/15 BD

[58] Field of Search ..... 110/185, 186, 110/187, 188, 189, 190, 191, 234, 260, 261, 263, 297, 347, 348, 341; 236/15 BA, 15 BB, 15 BD, DIG. 15; 432/36, 50; 431/13, 14, 18, 75, 12; 356/45, 315, 316

[56] References Cited

U.S. PATENT DOCUMENTS

| | | | |
|---|---|---|---|
| 4,168,785 | 9/1979 | Gabler et al. | 122/235 B |
| 4,368,031 | 1/1983 | Chadshay | 431/79 |
| 4,475,482 | 10/1984 | Moss et al. | 122/379 |
| 4,568,288 | 2/1986 | Patteson | 434/366 |
| 4,622,922 | 11/1986 | Miyagaki et al. | 122/449 |
| 4,756,684 | 7/1988 | Nishikawa et al. | 431/79 |
| 4,779,977 | 10/1988 | Rowland et al. | 356/45 |
| 4,887,958 | 12/1989 | Hagar | 431/12 |
| 5,139,412 | 8/1992 | Kychakoff et al. | 431/12 |
| 5,148,667 | 9/1992 | Morey | 60/39.02 |
| 5,181,482 | 1/1993 | Labbe et al. | 122/392 |
| 5,249,954 | 10/1993 | Allen et al. | 431/14 |
| 5,280,756 | 1/1994 | Labbe | 110/191 |
| 5,359,967 | 11/1994 | Carter et al. | 122/379 |
| 5,599,179 | 2/1997 | Lindner et al. | 431/12 |
| 5,606,924 | 3/1997 | Martin et al. | 110/341 |

FOREIGN PATENT DOCUMENTS

| | | | |
|---|---|---|---|
| 33 31 478 A1 | 3/1985 | Germany . | |
| 3331478 A | 3/1985 | Germany | 431/18 |
| 2-309117 | 12/1990 | Japan . | |
| 6-159641 | 6/1994 | Japan | 110/348 |

OTHER PUBLICATIONS

Control of $NO_x$ Emissions from Power Boilers, Rawdon and Johnson, Nov. 7, 1974.

Radiative Flame Cooling for Reduction of Nitric Oxide Emissions, Balakrishnan and Edwards, Aug. 5, 1973.

Acoustic Pyrometry–A New Tool for the Operation and Maintenance Diagnostics of Fossil Fueled Utility Boilers, Kleppe and Yori, Oct. 15, 1990.

Scientific Engineering Instruments, Inc.–Utility Listing undated.

Cleaning Advisor, Monitoring Tool for On–Line Boiler Cleanliness, Carter, Pezzi & Walther, 1991.

Using OPM to Lower Generation Costs, Jonas, Melland, 1991.

The Effect of Burner Tilt Angle on Unit Performance at Pepco's Morgantown Unit 2, D'Agostini, Levy, Curran, Pernandes, Leopold & Williams, May 7, 1991.

Furnace Cleaning in Utility Boilers Burning Powder Riven Basin Coals, Carter Koksal & Garrabrant, Oct. 18, 1992.

Flame Quality Analyzer for Temperature Measurement and Combustion Control, Bailey and Carter, 1988.

(List continued on next page.)

*Primary Examiner*—Carl D. Price
*Assistant Examiner*—Ljiljana V. Ciric
*Attorney, Agent, or Firm*—Rhodes Coats & Bennett, L.L.P.

[57] ABSTRACT

Information relating to combustion conditions within a fossil-fueled boiler that includes a plurality of burners adapted to produce flames combining to form a fireball is provided by acquiring data relating to the physical and temperature characteristics of the fireball with at least one imaging camera having optical and temperature measuring capabilities; receiving, storing and processing data received from the camera to provide data representative of the $NO_x$ content of the hot gases produced by the fireball; and transmitting the processed data from the processor to a monitor for display. Transmitted, processed data may include current, historical and target information relating to the physical appearance and temperature profile of the fireball.

12 Claims, 4 Drawing Sheets

OTHER PUBLICATIONS

Flame Image Monitoring and Analysis in Combustion Management, Nihtinen, 1992.

Dimac Combustion Management System, author & date unknown.

Article from Sensors Magazine, vol. 9 No. 1 Jan. 1992.

Radiant Zone Oxygen Sensing Technology: Key to Real-Time Boiler Combustion Control, Simpkins & Locklin, undated Combustion Control, Bailey and Carter, 1988.

Combustion Control for Elimination of Nitric Oxide Emissions from Fossil-Fuel Power Plants, Breen, Bell, De Volo, 1970.

$NO_x$ Emission Reduction by Furnace Cleanliness and Combustion Management, Carter and Larson, 1993.

Optimizing Sootblower Operation in Response to Changing Coal Quality & Boiler Operation, Johnson, Alfonso& Carter 1993.

EPRI Perspective on Plant Monitoring and Experience at Pepco's Morgantown 2, Williams & Gehl, undated.

COMBUSTION OPTIMIZATION SYSTEM

BACKGROUND OF THE INVENTION (1) Field of the Invention

The present invention relates to an improved method and apparatus for inplant, on-line monitoring of the combustion performance of utility boilers, in particular coal-fired boilers, providing information used by the boiler operator to adjust operating conditions to achieve an optimum balance between performance and $NO_x$ emissions.

(2) Description of the Prior Art

Utility boilers used to generate electricity are generally comprised of a combustion chamber having a plurality of burners positioned near its lower end and heat exchangers near and above the burners. A mixture of fuel, e.g., pulverized coal or oil, and air is fed to each burner forming a burner flame projecting into the combustion chamber. These individual flames combine to form a single flame area, generally referred to as a fireball. Heated gases rising from the fireball heat the heat exchangers converting water passing therethrough into steam used to power turbines for electricity generation. Since burning of the fuel also generates large quantities of soot or ash which accumulates on the walls of the combustion chamber and on the heat exchangers, the boiler also includes devices known as soot blowers adapted to periodically project streams of steam or other fluids, against the walls and other areas of the combustion chamber to remove the soot.

Various systems and methods have been proposed for monitoring and control of the environment within utility boilers in order to improve operating efficiencies and improve economics. Most of these systems and methods have been directed toward the timing of soot blowing operations to promote cleanliness of boiler walls and other areas where soot or ash tends to accumulate.

The need for improved control of combustion conditions, as opposed to the control of ash and soot deposition, has been necessitated by sections of the Clean Air Act Amendments of 1990 relating to reductions in the discharge of $NO_x$. Titles I and IV of the Act mandate $NO_x$ reductions from stationary sources, e.g., utility boilers, while Title IV (acid rain) requires the use of low $NO_x$ combustion technology and Title I (ozone non-attainment) requires RACT (reasonable available control technology).

$NO_x$ collectively refers to nitric oxide (NO), nitrogen dioxide ($NO_2$), and nitrous oxide ($N_2O$). NO, however, is the only nitrogen oxygen compound that can form, be stable, and exist in significant quantities in the high temperature portions of a utility boiler system. $NO_x$ formation from any combustion process using air has two major components, thermal $NO_x$ and fuel $NO_x$. The relative contribution of each depends primarily on the nitrogen content of the fuel and the temperature of the combustion process.

The formation of $NO_x$ is to a degree dependent on boiler heat transfer, which is affected by the amount of ash and soot on the boiler surfaces. Therefore, monitoring of ash and soot build-up and operation of soot blowers in response to these conditions is important to $NO_x$ formation. However, the key to $NO_x$ reduction during combustion is the combustion intensity. Combustion intensity refers to the time at the peak combustion temperature. The higher the combustion temperature and the longer the fuel and oxygen are at this peak temperature, the higher the $NO_x$ emission will be.

Utilities are evaluating various front-end combustion modification techniques, including low $NO_x$ burners, overfired air, and low excess air. Hardware, such as lower emission burners, has also become available to achieve the lower emissions. Optimization of fuel and air flow and other combustion parameters, however, in order to best utilize this hardware still requires the input of an experienced operator to evaluate boiler operating conditions and periodically adjust operating parameters, either manually or with automatically responsive systems.

Thus, while the prior art describes various monitoring apparatus and methods directed to control of soot blowers, there is also a need for an apparatus and method useful in providing the operator with additional and better information relating to boiler combustion conditions, assisting the operator in achieving an optimum balance between boiler performance and minimization of $NO_x$ emissions.

U.S. Pat. No. 5,359,967 to Carter et al. of which the current applicant is a co-inventor, describes a procedure for controlling $NO_x$ levels in a coal-fired boiler by monitoring the furnace exhaust gas temperature (FEGT) of the boiler, and cleaning the heat exchanger surfaces of the boiler when the temperature deviates from a desired range. At the same time, the fuel combustion rate of individual burners is monitored with temperature recording cameras, and air is provided to the burners until the fuel combustion rate is within a desired range.

A paper entitled "Flame Image Monitoring and Analysis In Combustion Management" by J. J. Nihtinen, also describes a system for monitoring individual burners within a boiler. This system, known as DIMAC (Digital Monitoring and Analysis of Combustion), is comprised of a plurality of cameras, one camera mounted perpendicular to each burner to be monitored, and an analyzing unit to analyze video images for burner type-specific flame parameters using specific algorithms. In front wall and opposite wall fired systems, the parameters measured are: ignition point, stability of ignition point, average intensity of the flame, and total intensity of the flame. The evaluated parameters in tangential burning systems are: position of ignition point on fuel system, stability of ignition location, height of fuel stream, upper flashpoint in combustion window, and lower flashpoint in combustion window.

There is still a need, however, for a method and apparatus for acquiring additional information relating to combustion performance, and presenting this information to the operation in a manner useful to the operator in making timely adjustments. Specifically, it is an aspect of the invention to provide combustion monitoring and optimization diagnostic system capable of acquiring and presenting on-line and stored visual qualitative and quantitative combustion information, from which it is possible for plant personnel to verify and refine burner operation and $NO_x$ reduction strategy.

SUMMARY OF THE INVENTION

The present invention provides an improved system and method for acquiring information relating to utility boiler combustion conditions, not heretofore available to the operator, by monitoring the physical appearance and temperature of a fireball within the combustion chamber of a boiler, especially a coal-fired boiler. The system is comprised of at least one imaging camera with integral temperature measurement capability positioned to monitor combustion of the fireball, an image processor adapted to process information acquired by the camera, and a monitor adapted to display the processed information so that an operator can act in an efficient and timely manner to achieve optimum performance, while minimizing $NO_x$ emissions. The imaging camera can be supported on a mount. The system may also include a controller for automatically adjusting combustion parameters, such as air flow, fuel flow, or the air/fuel ratio, in response to data generated.

The camera used in the present system, commercially available for other purposes, may be solid state CCTV cameras with integral temperature measurement capability. Suitable cameras are the DPSC Flameview and QUADTEK SPYROMETER. While it is known that such cameras can be used to obtain a visual and temperature flame profile of individual burners in a boiler, as shown for instance in the above Carter et al. patent, this information has not been previously employed in an integrated system to aid the operator in assessing overall fireball characteristics, including location, shape, temperature and $NO_x$ emission.

The imaging camera is preferably positioned to view the interior of the boiler through a port located in the boiler side wall at an elevation such that all or most of the fireball can be viewed with the camera, e.g., approximately midway between the lower and upper elevation of the furnace or combustion chamber. The port may be an existing view port, or a port formed in the boiler side wall specifically for this purpose. From this vantage point, all or selected portions of the fireball can be viewed.

The camera is connected by cable to an image processor to process visual and temperature information received from the camera. The live data, alone and combined with stored data, provides the operator with several types of information required to fully evaluate the condition of the boiler and determine action required. The types of data available to the operator include a) live fireball combustion images, b) temperature profiles, c) stored images for comparison with live images, and d) target images for comparison to the live image.

The live mode provides a continuous, full screen visual image of the fireball at selected locations. The intensity mode is similar in operation to the live mode; however, the live image is replaced by the temperature contours. A portion of the furnace or boiler wall is preferably included in the live view to provide spatial orientation and allow determination of fireball position in the furnace.

Direct observation of live fireball images is useful in on-line identification of fireball shape, position and temperature distribution, with dark colors indicating low temperature, and bright colors indicating high temperature. This information permits, for example, detection and identification of skewing of fireball concentricity which leads to degraded heat transfer, corresponding temperature and $NO_x$ increases, increased slagging of heat transfer surfaces, and non-uniform heat transfer in heat passages. An irregularly shaped fireball also indicates burner problems.

The image processor is also capable of converting the received live image into a temperature profile by analyzing the fireball at a plurality of cursor locations and wavelengths. This conversion allows the live images to be displayed to the operator as temperature contour lines. The contour lines, which normally will be set to differ by −100° F., provide insight into temperature volume and time at temperature.

Since $NO_x$ production in a fossil fuel system is directly and strongly influenced by temperature, it has been previously observed that most $NO_x$ production occurs at temperatures above about 2700°–2800° F. Also, the level of $NO_x$ production is strongly influenced by the ratio of air to fuel. FIG. 3 illustrates the relationship between $NO_x$ production, combustion temperature and equivalence ratio for a selected fuel. $NO_x$ formation is a maximum for slightly air-rich ratios (equivalence <1) and decreases rapidly as the mixture becomes increasingly air or fuel rich. Combustion temperature, however, is a maximum for slightly fuel rich mixture ratios (equivalence ratio >1) and, like $NO_x$ production, decreases rapidly as the mixture becomes increasingly air or fuel rich.

Conventionally (non-low $NO_x$) burners typically operate air rich mixtures to ensure complete fuel burnup. For a fixed burner/boiler arrangement, FIG. 4 illustrates the relationship between $NO_x$ and combustion temperatures for air rich mixtures. This indicates that combustion temperatures can provide insight into $NO_x$ production and the influence of operational changes to control $NO_x$ production.

Burners designed for obtaining lower $NO_x$ production are generally based on two principals: off-stoichiometric operation and mixing controlled combustion. SOFA (separate over-fired air) and CCOFA (close-coupled overfired air) ports direct a portion of the combustion air away from the primary combustion zone. Primary combustion occurs at off-stoichiometric, fuel rich conditions. The decreased oxygen concentration retards the chemical reaction rate in the equations $N_2+O \leftrightharpoons NO+N$ and $N+O_2 \leftrightharpoons NO+O$. The secondary combustion occurs at lower bulk gas temperatures, due to the mixing of additional furnace air, reducing the $NO_x$ production rates. The amount of air directed through the SOFA and CCOFA ports varies with load because of other burner considerations. As a result, the mixture conditions in the primary combustion zone may be fuel rich at full load (when the SOFA and CCOFA ports are near full open) and air rich at low loads (when the SOFA and CCOFA ports are nearly closed.)

FIG. 5 illustrates the relationship between $NO_x$ production and combustion temperatures that can occur. Two distinct $NO_x$ production/combustion temperature curves result, one for air rich mixture ratios and one for fuel rich mixture ratios with a transition near stoichiometric conditions. This explains the low load high $NO_x$ peaks that occur in many plants equipped with low $NO_x$ burners. In plants that pass from the air rich to the fuel rich mixture ratio regions, combustion temperatures and oxygen information is needed to provide insight into $NO_x$ production and the influence of operation changes to control $NO_x$ production.

For a given boiler, the combustion system is defined. That is, the aerodynamics are constant and, thus, the time in the combustion intensity determinant is constant. Therefore, $NO_x$ emission is directly related to combustion temperatures for an air rich or fuel rich process and related to combustion temperatures and oxygen concentration for a system that experiences both air and fuel rich conditions.

The measured spatially resolved temperatures are used as input to a chemical kinetics model to estimate the reactions and resulting emissions.

The information determined through observation, combined with the image storage feature, enables the operator to derive estimates of $NO_x$. Also, live visual and calculated temperature information can be simultaneously presented to provide qualitative and quantitative performance information. The imaging system also enables the user to select the color scheme, e.g., red/yellow, red/white, black/white, or magenta/yellow.

In addition to the above on-line information, image storage capability within the image processor is available to store desired and historical fireball images. The stored images can be displayed for direct comparison to the current or live image to aid in diagnosing fireball problems. The stored image is also used to determine the cause for increases or decreases in $NO_x$ emission. Fireball images are stored for future reference to compare stored and current images, and to assess emission performance changes observed over time. Comparison of stored and live images can be obtained. The information may be displayed in live or intensity mode. Information relative to $NO_x$ emission performance is also provided. The stored and live image sets can be compared to assess the increase or decrease in live emissions compared to the stored reference.

Trend information i.e., information showing changes in monitored parameters, such as $NO_x$ emissions, over a period of time, is also recorded and stored in the image processor. In addition to the live screen, a separate trend screen is available displaying a plot of cursor trends on a single axis to allow direct comparisons. $NO_x$ trends determined by the kinetic reactions using the measured combustion temperature as input, or by direct stack measurement, and measured temperatures will be displayed. The processor also stores target information for desired loads, such as minimum load, full load and ¾ load conditions. This information is available for comparison with current conditions.

The monitor is connected to the image processor and is adapted to display any type of information generated by the image processor, so that it is available to the operator.

In operation, the imaging camera is positioned adjacent the boiler to observe the fireball within the boiler. Digitally colorized images of the fireball and temperature information are transmitted to an image processor for display and analysis. The processor processes the data from the camera to generate data including fireball temperature profiles, trend data, and comparative data relative to a target. This data can then be displayed in the manner desired on a monitor in a position for study by the operator.

Accordingly, one aspect of the present invention is to provide a system for monitoring combustion in a fossil-fueled boiler, the boiler including a plurality of burners producing a plurality of flames combining to form a fireball, a furnace section or combustion chamber within which the fireball is formed, and an exit formed by the boiler. The apparatus includes: (a) at least one monitor having optical and temperature measuring capabilities for providing data representative of the optical and temperature characteristics of the fireball; and (b) a processor connected to the monitor, the processor being adapted to receive, store and process data received for the monitor, and to provide data representative of the $NO_x$ content of the hot gases produced by the fireball.

Another aspect of the present invention is to provide a system for monitoring the fireball within a fossil-fueled boiler, the boiler including a plurality of burners, a furnace section and an exit for the hot gases produced by the boiler. The apparatus includes: (a) an imaging camera having temperature measuring capabilities positioned to monitor a major portion of the fireball, and preferably a portion of the furnace wall, to provide data representative of the temperature profile of the fireball over a predetermined period of time; (b) a processor connected to the imaging camera adapted to receive, store and process data received from the camera and (c) a monitor connected to the processor to receive and display information transmitted from said processor. The system can also include means connected to the processor for controlling air and/or fuel flow in response to data transmitted by the processor.

Still another aspect of the present invention is to provide a system for monitoring combustion conditions within a fossil-fueled boiler, the boiler including a plurality of burners, a furnace section and an exit for the hot gases produced by the boiler. The apparatus includes: (a) an imaging camera having temperature measuring capabilities positioned to monitor a major portion of the fireball, and preferably a portion of the furnace wall, to provide data representative of the physical shape and temperature characteristics of the fireball over a predetermined period of time; and (b) a processor connected to the imaging camera adapted to receive, store and process data received from the camera and to provide data corresponding to the spatially resolved combustion temperature of the fireball, the $NO_x$ content of the hot gases ($NO_x$) being related to the spatially resolved combustion temperature (SRCT) according to the use of SRCT in a set of reaction equations where the reaction rate is $K=A*SRCT^{-N}\exp(-B/R*SRCT)$, where A, N, B and R are constant for a specific reaction equation; and (c) at least one air/fuel control element for receiving the data from the processor and a predetermined set point for the fireball, the control system being operable to adjust the air/fuel control element in response to the data and the set point. A, N and B are empirically determined constants for the particular element or compound being analyzed, and are readily found in generally available texts, such as the text of the *Thirteenth Symposium (International) on Combustion*, by The Combustion Institute, 1971. R is the universal gas constant.

These and other aspects of the invention will be apparent to those skilled in the art upon a reading of the detailed description of the preferred embodiment which follows, taken together with the drawings.

DETAILED DESCRIPTION OF THE PREFERRED EMBODIMENT

Figure 2:
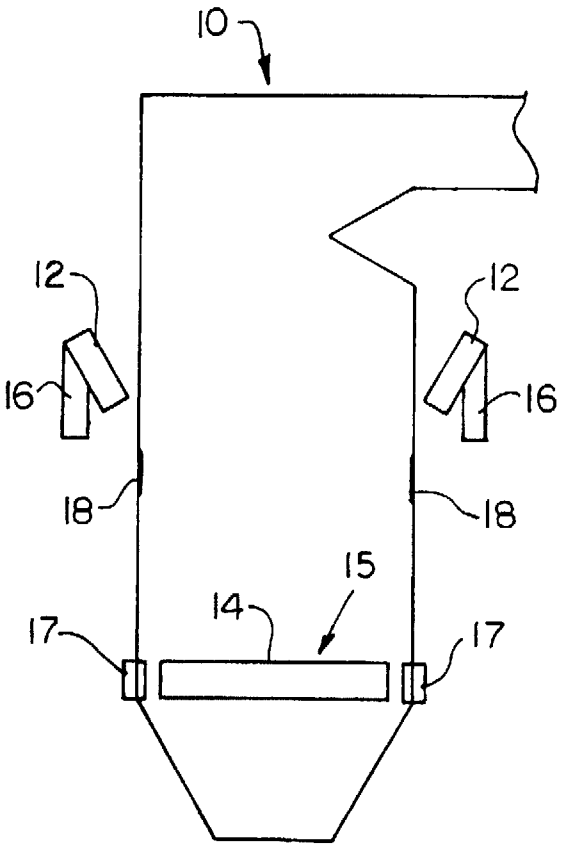
FIG. 2 is a diagrammatic side view of a boiler showing positioning of the cameras.
Figure 1:
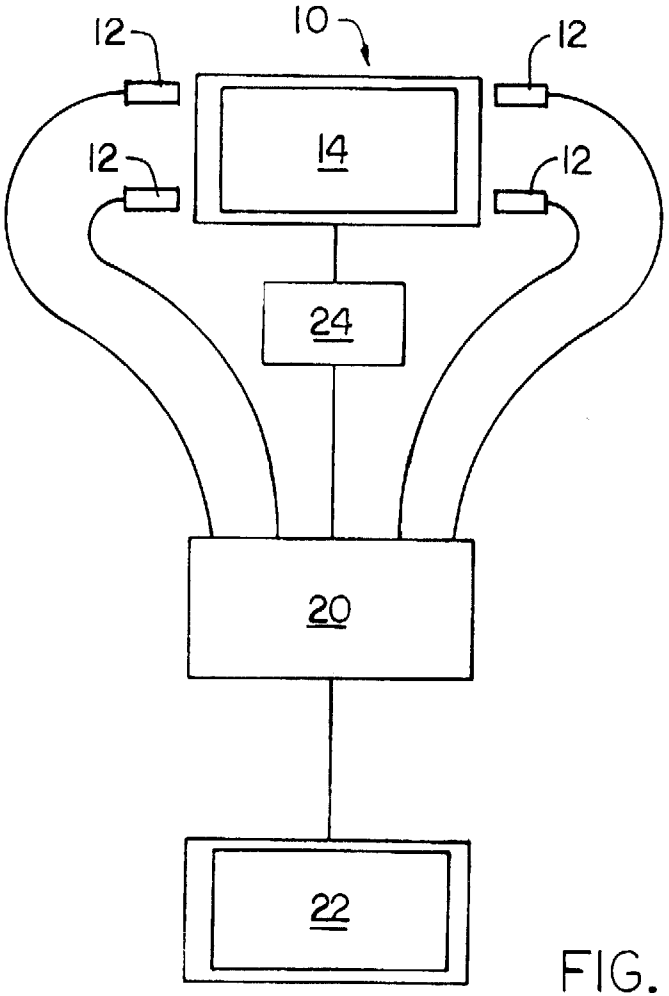
FIG. 1 is a diagrammatic illustration of the present system associated with a boiler as viewed from the top.
Figure 3:
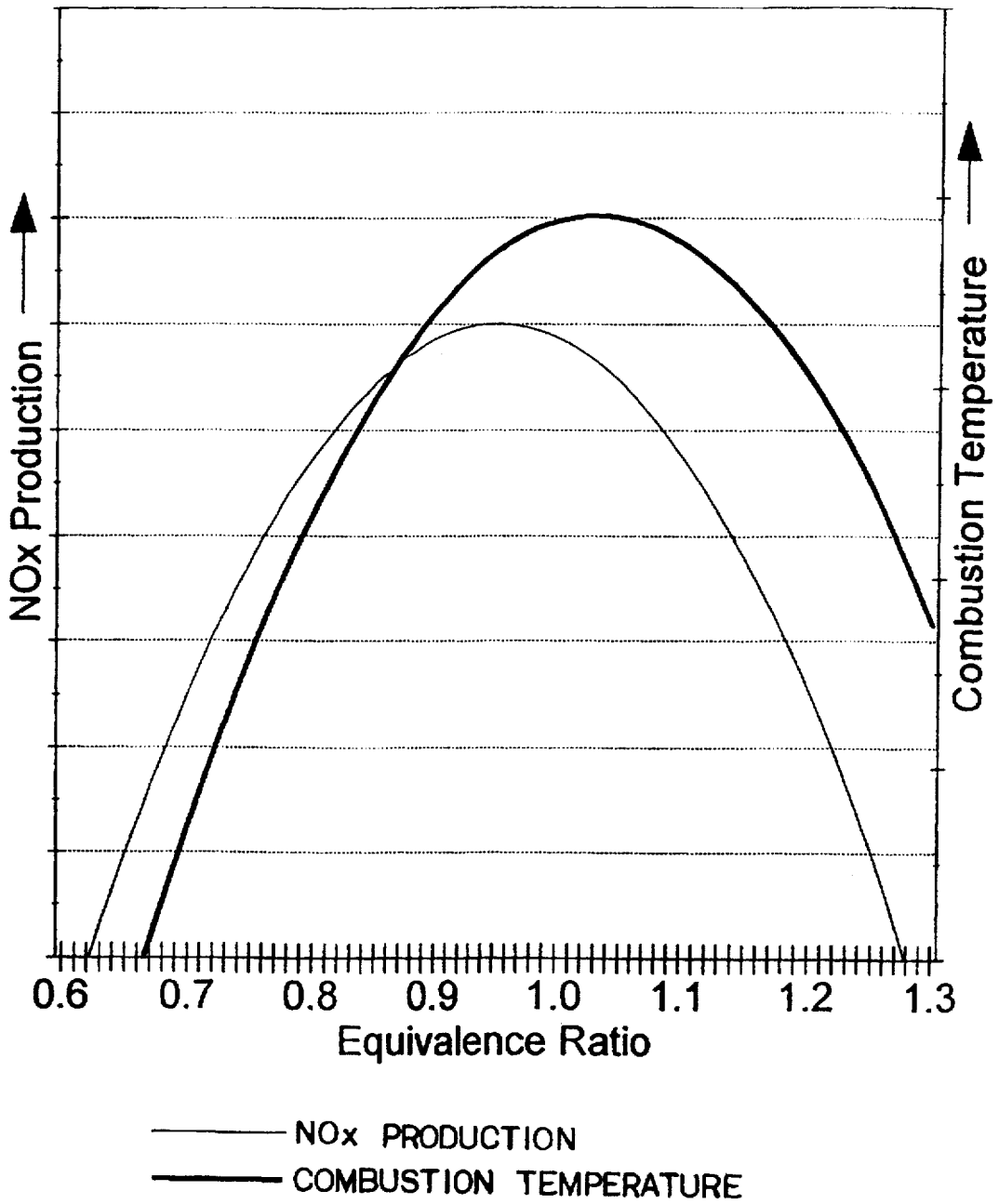
FIG. 3 is a graph illustrating the relationship between $NO_x$ production, combustion temperature and equivalence ratio for a selected fuel.
Figure 4:
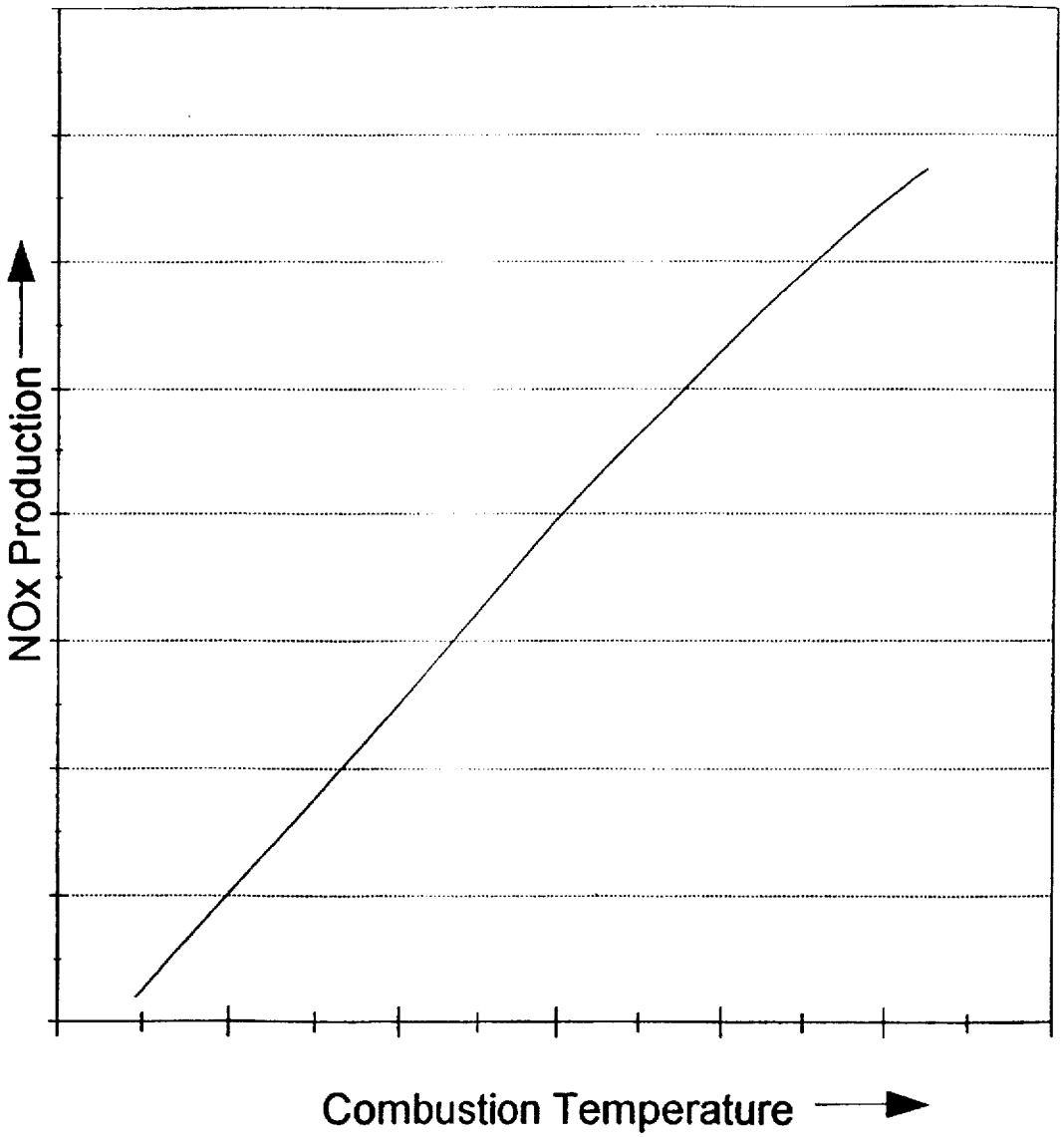
FIG. 4 is a graph illustrating the relationship between $NO_x$ and combustion temperatures for air rich mixtures.
Figure 5:
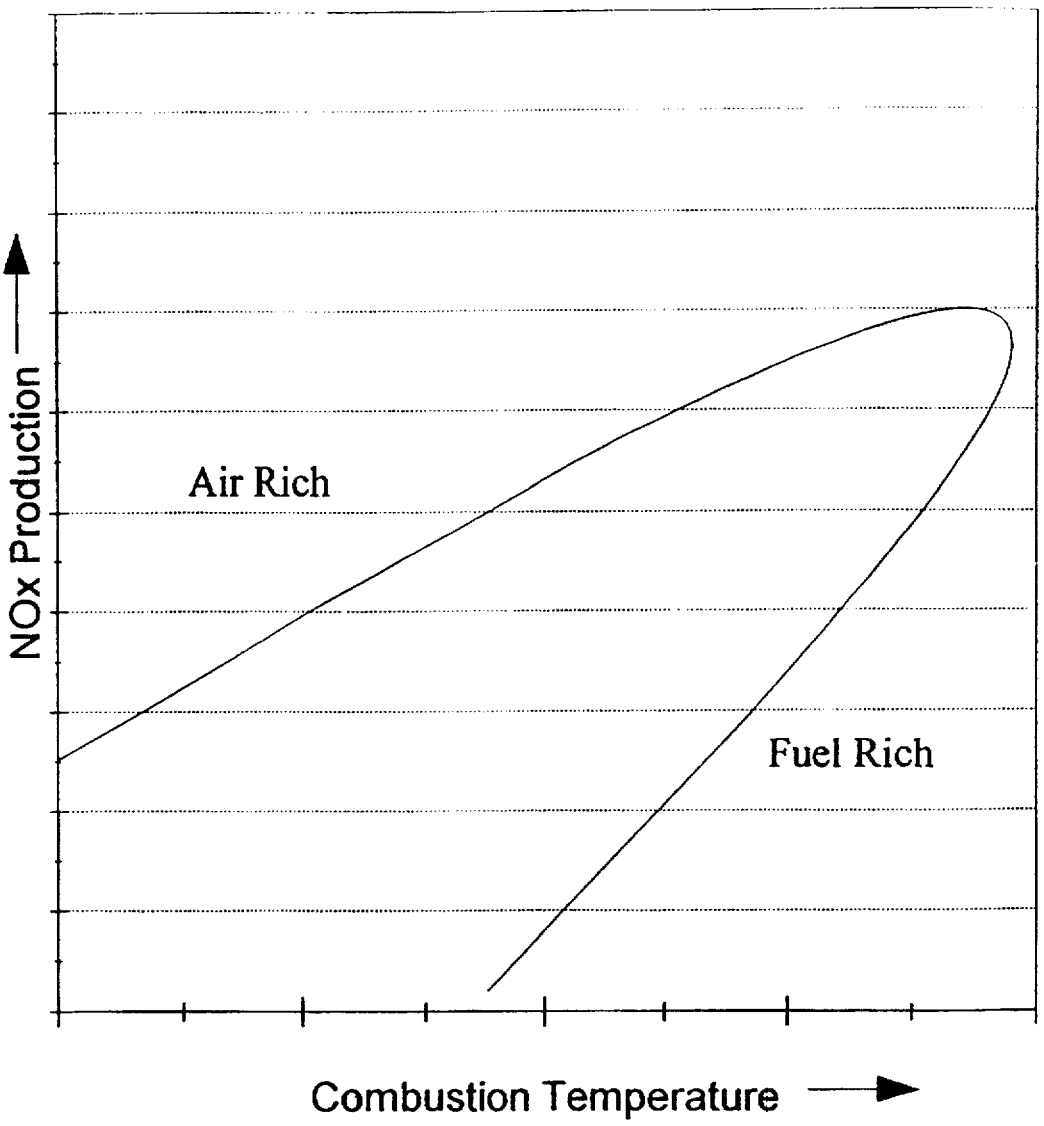
FIG. 5 is a graph illustrating the relationship between $NO_x$ production and combustion temperatures.

In the following description, like reference characters designate like or corresponding parts throughout the several views. Also in the following description, it is to be understood that such terms as forward, rearward, left, right, upwardly, downwardly, horizontal, upright, vertical, above, below, beneath, and the like, are used solely for the purpose of clarity in illustrating the invention, and should not be taken as words of limitation. As illustrated in FIGS. 1 and 2, conditions within a boiler, generally 10, are monitored by the present system, which is comprised of one or more cameras 12 positioned to view the upper surface of fireball 14 within furnace section 15 of boiler formed by a plurality of burners 17 positioned in a substantially horizontal plane 10. Each camera 12 is supported on a mount 16 and is positioned to view the interior of boiler 10 through lens port 18. Placement of the imaging camera 12 as shown, provides relatively clear access to the overall shape of the boiler and to portions of the boiler, as well as fireball 14. It will be apparent to one skilled in the art upon reading the description of the invention that a plurality of cameras can be used, if simultaneous viewing of different portions of fireball 14 is desired.

Camera 12 communicates with an image processor 20 adapted to store and process visual and temperature information acquired by cameras 12. Processor 20 is, in turn, connected with monitor 22 adapted to display images received from processor 20, so that they can be viewed by the operator. In addition, processor 20 may be operatively connected to an air/fuel control element 24 for controlling the air/fuel ratio of the boiler.

During operation, data relating to the physical and temperature characteristics of fireball 14 are acquired by positioning a camera 12 to view fireball 14 within boiler 10 through a lens port 18. Mount 16 supports camera 12 at the location for the view desired.

Data acquired by camera 12 is transmitted to image processor 20 for storage and processing. Data processed by processor 20 is, in turn, transmitted to monitor 22 for display to the operator. Alternatively, or simultaneously, the data may be transmitted to air/fuel control element 24 for controlling the air/fuel ratio of the boiler.

Certain modifications and improvements will occur to those skilled in the art upon a reading of the foregoing description. For example, the boiler may include additional combustion control elements, such as burner tilt mechanisms, which may operate separately, or be interconnected with the present system. Also, the system may be utilized with a variety of different boiler types, including wall fired and tangentially fired boilers. It should be understood that all such modifications and improvements have been deleted herein for the sake of conciseness and readability but are properly within the scope of the following claims.

What is claimed is:

1. A system for providing information relating to combustion conditions within a fossil-fueled boiler that includes a side wall, a furnace section, a plurality of burners positioned in a substantially horizontal plane and adapted to produce flames combining to form a fireball within said furnace section, and an observation port located in the boiler side wall above the furnace section, said system comprising:

a) at least one imaging camera having optical and temperature measuring capabilities, said camera being positioned outside of said boiler and directed downwardly to view a major portion of the upper surface of said fireball through said port and provide data representative of the shape, position, and temperature distribution of said fireball;

b) a processor connected to said camera to receive, store and process data received from said camera and to provide data representative of the $NO_x$ content of hot gases produced by the fireball; and (c) a monitor connected to said processor to receive and display data from the processor.

2. The system according to claim 1, further including a mount supporting said camera.

3. The system according to claim 1, further including at least one air/fuel control element connected to said processor for controlling the air/fuel ratio of said fossil-fueled boiler.

4. The system according to claim 1, wherein said processor is capable of displaying current and historical data on said monitor.

5. The system according to claim 1, wherein said fossil-fueled boiler is a pulverized coal boiler.

6. A system for providing information relating to combustion conditions within a fossil-fueled boiler that includes a side wall, a furnace section a plurality of burners positioned in a substantially horizontal plane and adapted to produce flames combining to form a fireball within said furnace section and an observation port located in the boiler side wall above the furnace section, said system comprising:

a) at least one imaging camera having optical and temperature measuring capabilities, said camera being positioned outside of said boiler and directed downwardly to view a major portion of the upper surface of said fireball through said port and provide data representative of the shape, position, and temperature distribution of said fireball;

b) a processor connected to said camera to receive, store and process data received from said camera, and transmit current, historical and target information relating to the physical and temperature characteristics of said fireball;

c) at least one air/fuel control element connected to said processor to control the air/fuel ratio of said fossil-fueled boiler based upon said information transmitted by said processor; and d) a monitor connected to said processor to receive and display said information transmitted by said processor.

7. A method for providing information relating to combustion conditions within a fossil-fueled boiler that includes a side wall, a furnace section, a plurality of burners positioned in a substantially horizontal plane and adapted to produce flames combining to form a fireball within said furnace section, and an observation port located in the boiler side wall above the furnace section, the method comprising:

a) positioning at least one imaging camera having optical and temperature measuring capabilities outside of said boiler and directed downwardly to view a major portion of the upper surface of said fireball through said port;

b) acquiring data representative of the shape position and temperature distribution of said fireball with said camera;

c) receiving, storing and processing said data to produce processed data representative of the $NO_x$ content of hot gases produced by said fireball; and (d) transmitting data to a monitor, and displaying data thereon.

8. The method of claim 7, wherein said camera is also positioned to view a portion of said wall in said furnace section.

9. The method of claim 7, wherein said processed data transmitted to said monitor includes current, historical and target information relating to the physical appearance and temperature profile of said fireball.

10. The method of claim 7, further including the step of controlling the air/fuel ratio of said fossil-fueled boiler.

11. The method of claim 7, wherein said processed data is displayed with target information relating to the physical appearance and temperature profile of said fireball.

12. The method of claim 7, wherein said processed data is displayed with historical information relating to the physical appearance and temperature profile of said fireball.

* * * * *